US009303384B2

(12) United States Patent
Wyatt et al.

(10) Patent No.: US 9,303,384 B2
(45) Date of Patent: Apr. 5, 2016

(54) CAVITATING WATER JET HARD ROCK DREDGE MINING SYSTEM

(71) Applicants: Christopher J. Wyatt, Golden, CO (US); Hugh Bennett Miller, Golden, CO (US)

(72) Inventors: Christopher J. Wyatt, Golden, CO (US); Hugh Bennett Miller, Golden, CO (US)

(73) Assignee: Colorado School of Mines, Golden, CO (US)

( * ) Notice: Subject to any disclaimer, the term of this patent is extended or adjusted under 35 U.S.C. 154(b) by 148 days.

(21) Appl. No.: 14/255,098

(22) Filed: Apr. 17, 2014

(65) Prior Publication Data

US 2014/0310997 A1 Oct. 23, 2014

Related U.S. Application Data

(60) Provisional application No. 61/813,047, filed on Apr. 17, 2013.

(51) Int. Cl.
*E02F 3/88* (2006.01)
*E02F 3/90* (2006.01)
*E02F 3/92* (2006.01)

(52) U.S. Cl.
CPC ..... *E02F 3/8833* (2013.01); *E02F 3/907* (2013.01); *E02F 3/9218* (2013.01)

(58) Field of Classification Search
USPC ..... 37/195, 321, 323, 324, 326
IPC ..... E02F 3/88,3/92, 3/9225, 3/9262, 3/9268, E02F 3/8833
See application file for complete search history.

(56) References Cited

U.S. PATENT DOCUMENTS

| | | | | |
|---|---|---|---|---|
| 4,024,655 | A * | 5/1977 | Schweitzer | E02F 3/9293 37/187 |
| 4,084,334 | A * | 4/1978 | Wolters | E02F 3/905 37/310 |
| 4,322,897 | A * | 4/1982 | Brassfield | E02F 3/9243 37/322 |
| 4,398,362 | A * | 8/1983 | Weinert | E02F 3/8858 37/189 |
| 4,631,844 | A * | 12/1986 | Deal | E02F 5/006 37/324 |
| 6,209,965 | B1 * | 4/2001 | Borns | E02F 3/925 299/17 |
| 6,578,294 | B2 * | 6/2003 | Ollinger, IV | E02F 3/9231 299/87.1 |
| 7,647,712 | B2 | 1/2010 | Tack | |
| 7,739,812 | B2 * | 6/2010 | Wijma | E02F 3/9212 299/87.1 |
| 2002/0104238 | A1 | 8/2002 | Ollinger | |
| 2011/0239493 | A1 * | 10/2011 | Tack | E02F 3/9212 37/333 |

* cited by examiner

*Primary Examiner* — Gary Hartmann
(74) *Attorney, Agent, or Firm* — Sheridan Ross P.C.

(57) ABSTRACT

The present invention provides a system and method to efficiently and effectively dredge in the presence of hard rock. An additional aspect of the present invention is to provide a system that induces cavitation bubbles and/or a vortex flow within a dredging cutter head by use of water jets mounted within a cavity of the cutter head. The cavitation bubbles and/or vortex flow produced by the water jets urge comminution of hard rock encountered during dredging operations, providing a more effective and efficient dredging of waterways than conventional approaches.

20 Claims, 5 Drawing Sheets

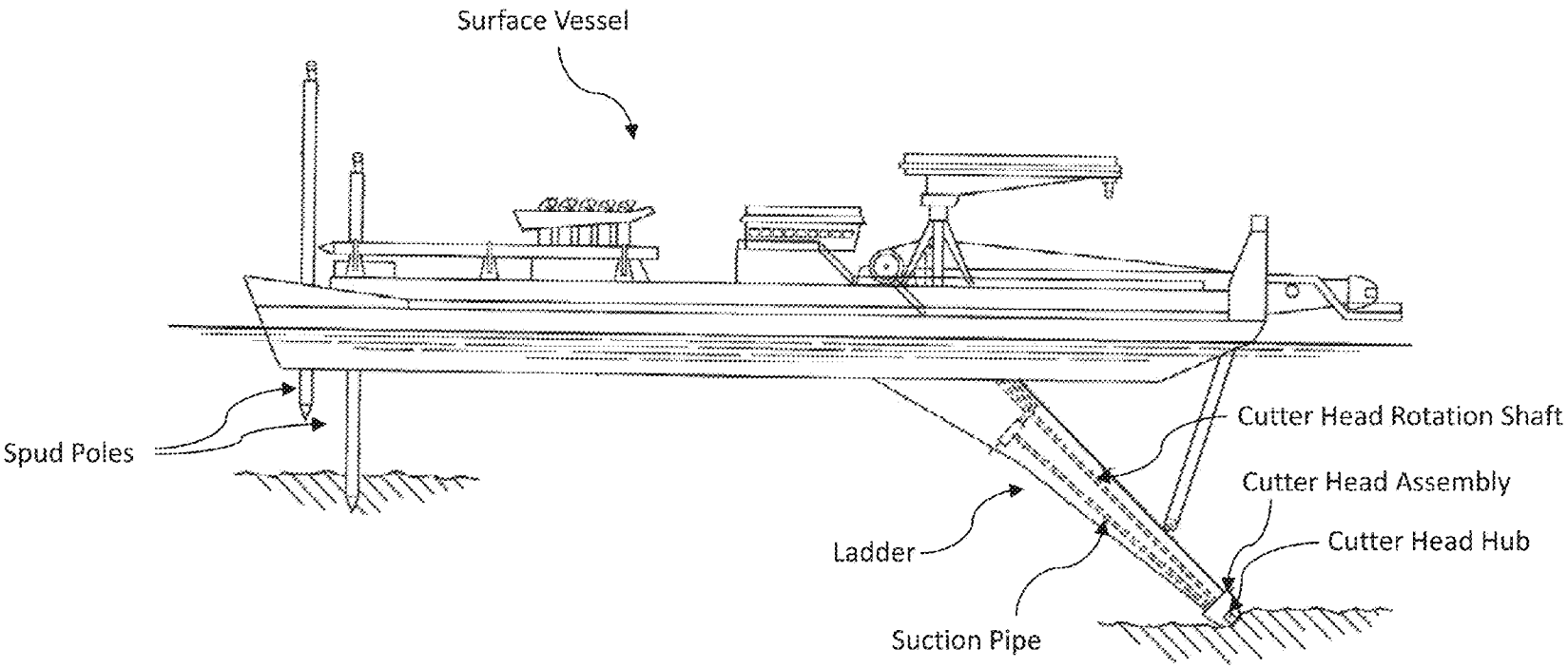
Fig. 1: Prior Art

CAVITATING WATER JET HARD ROCK DREDGE MINING SYSTEM

CROSS REFERENCE TO RELATED APPLICATIONS

This application claims the benefit of U.S. Provisional Patent Application No. 61/813,047 entitled "Cavitating Water Jet Hard Rock Dredge Mining System" filed on Apr. 17, 2013, the entire disclosure of which is incorporated by reference herein.

FIELD OF THE INVENTION

Embodiments of the present invention are generally related to a system for dredging and, in particular, to an apparatus and method for a cutting head that efficiently and effectively dredges in the presence of hard rock.

BACKGROUND OF THE INVENTION

Excavation of waterways, i.e. dredging, is a recurrent requirement to maintain waterway navigability. A common dredging technique is to suction material from the bottom of a waterway up to a surface vessel. A tube or pipe is traditionally used as the suction means. When dredging is required in geological areas with hard materials, such as rock, a cutter head is installed at the end of the suction tube. The cutter head is used to loosen and comminute the hard materials to enable their suction up to the surface vessel.

Traditional cutter-suction dredgers mount a suction pipe to a ladder lowered from the surface vessel to the waterway bottom. A rotation shaft is affixed to the ladder to drive the rotating cutter head. Ideally, the cutter head serves to dislodge and break-apart hard rock which is then suctioned up to the surface vessel. In practice, much of the broken or loosened hard rock material tends to not enter the suction tube, and instead disperses. As a result, dredging operations involving hard rock tend to be inefficient if not significantly ineffective.

Some efforts have been made to improve the operations of cutter-suction dredgers. For example, U.S. Pat. No. 7,647,712 to Tack ("Tack") discloses a dredging cutter head of cage-shaped support construction intended to improve hard rock comminution. The cutter head is conventionally mounted to the ladder of a suction dredger and engaged with a drivable rotation shaft. The cutter head has a circumferential surface provided with a number of cuffing tools for penetrating hard rock, the cuffing tools comprising a number of disc-shaped penetration bodies of which the disc planes extend substantially perpendicular to the rotation shaft, so that they can transfer forces to the rock via their peripheral edges. However, Tack fails to teach several novel features of the present invention, including the use of water jets within a dredging cutter head configured to induce cavitation bubbles and/or a vortex flow within the dredging cutter head. Tack is incorporated herein by reference in its entirety.

Efforts have been made to improve the design of cutter heads of cutter-suction dredgers to improve the movement of comminuted rock into the suction intake. For example, U.S. Patent Publication No. 2002/0104238 to Ollinger IV ("Ollinger") discloses a dredge cutter head with multiple helical arms interconnecting a hub and a ring. Each of the arms has a front leading edge for the attachment of cutting teeth. Each of the arms has a trough portion. The arm is shaped such that dredged material is directed toward the ring along the center of the trough portion. Further, the ring of the cutterhead defines an annular channel for receiving loosened material. However, Ollinger fails to teach several novel features of the present invention, including the use of water jets within a dredging cutter head configured to induce cavitation bubbles and/or a vortex flow within the dredging cutter head. Ollinger is incorporated herein by reference in its entirety.

Thus, there is a long-felt need for a system and method to efficiently and effectively dredge in the presence of hard rock, as provided in the present invention. An additional aspect of the present invention is to provide a system that induces cavitation bubbles and/or a vortex flow within a dredging cutter head by use of water jets mounted within a cavity of the cutter head. The cavitation bubbles and/or vortex flow produced by the water jets urge comminution of hard rock encountered during dredging operations. The system and method provide several benefits, to include a more effective and efficient dredging of waterways thereby yielding a more cost and time effective utilization of material, labor, and equipment.

SUMMARY OF THE INVENTION

It is one aspect of the present invention to provide a system for dredging, and to provide an apparatus and method to efficiently and effectively dredge in the presence of hard rock. An additional aspect of the present invention is to provide a plurality of water jets within a dredging cutter head. Further, the apparatus may be configured to induce cavitation bubbles and/or a vortex flow within a dredging cutter head for use in dredging operations.

In one embodiment of the invention, a cutter head and water jet assembly for removing rock and debris is disclosed, the cutter head and water jet assembly comprising: an assembly body having a lower portion, an upper portion, and a cutter head engaged with the assembly body, the cutter head comprising an interior surface defining a cavity and adapted to comminute solid material present during dredging; and an output port positioned on the upper portion which is adapted to emit a water jet into the cavity; wherein the water jet assembly creates cavitation bubbles within the cavity, the cavitation bubbles urging comminution of solid material disposed within the cavity.

In another embodiment of the invention, a method for dredging a waterway is disclosed, the method comprising: providing a cutter head and water jet assembly, the assembly comprising an assembly body having an upper portion engaged with each of a suction pipe and a rotation shaft, and a lower portion comprising a cutter head, the upper portion and the lower portion defining a cavity; and one or more water jets disposed on a surface of the cavity and configured to emit a spray of water into the cavity; positioning the cutter head on the bottom of the waterway; rotating the cutter head through rotation of the rotation shaft; suctioning particles comprising solid materials into the cavity; emitting a spray of water into the cavity from the one or more water jets; creating cavitation bubbles within the cavity, the cavitation bubbles urging comminution the solid materials disposed within the cavity; and suctioning the particles from the cavity into the suction pipe to a surface vessel, wherein the waterway is dredged.

In another embodiment of the invention, a cutter head and water jet device adapted to remove solid materials in a dredging operation is disclosed, the device comprising: a device body having an upper portion engaged with each of a suction pipe and a rotation shaft, and a lower portion comprising a cutter head, the upper portion and the lower portion defining a cavity, wherein the rotation shaft is configured to rotate the cutter head, and wherein the suction pipe is configured to suction particles comprising solid materials into the cavity;

and a plurality of water jets disposed on a surface of the cavity and configured to emit a spray pattern of water into the cavity, the spray pattern comprising a planar spray, a spherical spray, a conical spray and a pulsed spray; wherein the plurality of water jets create cavitation bubbles within the cavity, the cavitation bubbles urging comminution the solid materials disposed within the cavity; and wherein the plurality of water jets operate at adjustable water pressures, wherein the plurality of water jets emit water at adjustable orientations with respect to a centerline of the rotation shaft.

The term "automatic" and variations thereof, as used herein, refers to any process or operation done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material."

The term "breach" or "bank" or variations thereof refers to the portion of a waterway bottom engaged by a dredging device, such as a cutter head of a dredging device.

The term "cavitation" and variations thereof, as used herein, refers to the formation and collapse of low-pressure bubbles in liquids.

The term "controller", "automatic control" and variations thereof, as used herein, refers to automatic management and/or direction of a process or device by a control device or system.

The term "comminute", "comminution" and variations thereof, as used herein, refers to the reduction in size of solid materials by, for example, breaking-up, crushing, or pulverizing.

The term "vortex", "vortex flow" and variations thereof, as used herein, refers to fluid flow of a spinning or rotational nature.

The term "water jet", "waterjet" and variations thereof, as used herein, refers to a directed and/or controlled stream of water.

This Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention, and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below. However, the Detailed Description of the Invention, the drawing figures, and the exemplary claim set forth herein, taken in conjunction with this Summary of the Invention, define the invention.

BRIEF DESCRIPTION OF THE DRAWINGS

The accompanying drawings, which are incorporated in and constitute a part of the specification, illustrate embodiments of the invention and together with the general description of the invention given above, and the detailed description of the drawings given below, serve to explain the principals of this invention.

FIG. 1 depicts a prior art conventional dredging operation;

Figure 2A:
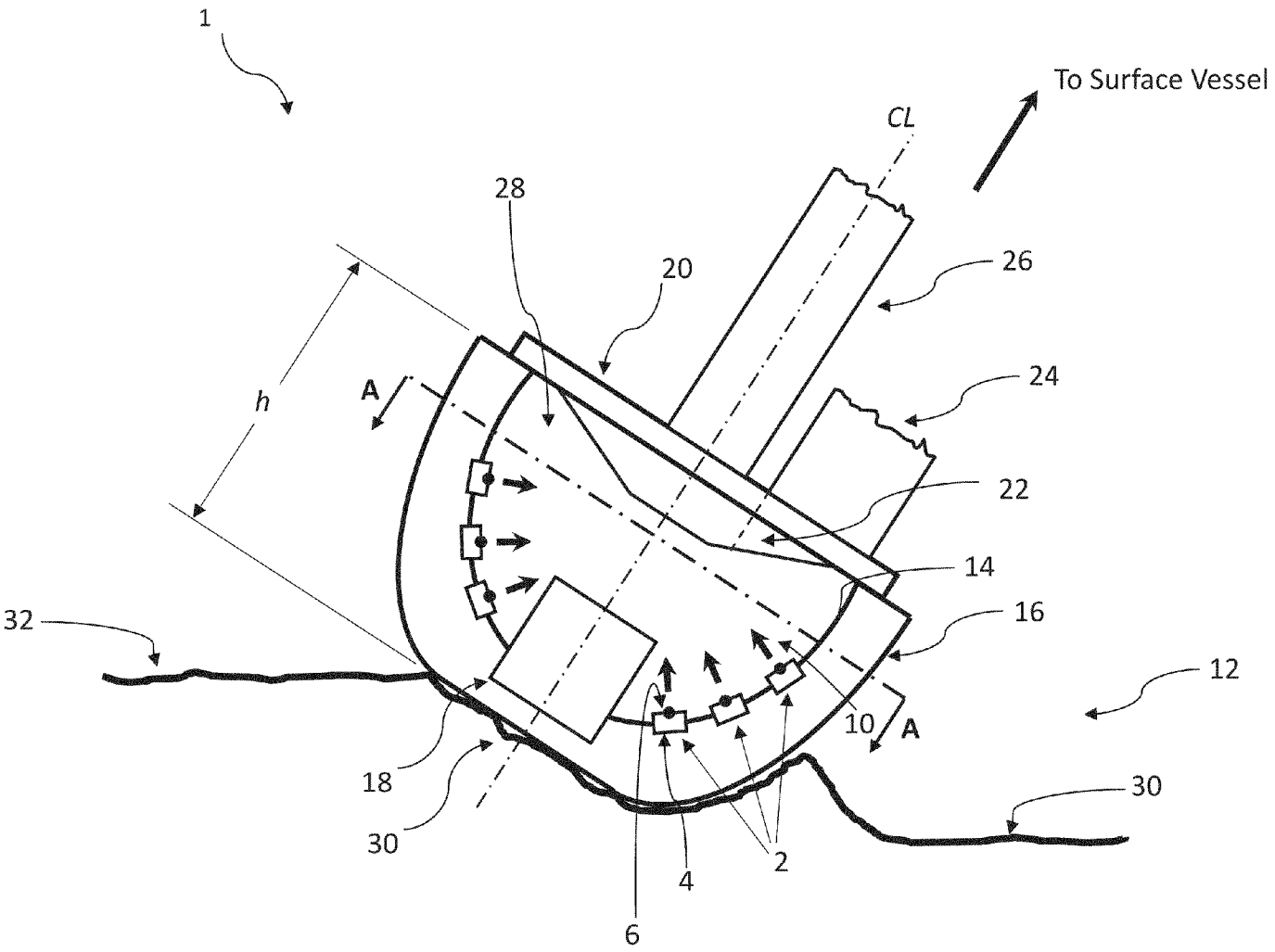
FIG. 2A depicts a cross-sectional side elevation view of a portion of the dredge mining system of one embodiment of the present invention.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

To assist in the understanding of the present invention the following list of components and associated numbering found in the drawings is provided herein:

| Reference No. | Component |
|---|---|
| 1 | Dredge Mining System |
| 2 | Water Jet Assembly |
| 4 | Water Jet Assembly Lower Portion |
| 6 | Water Jet Assembly Upper Portion |
| 8 | Water Jet Assembly Output Port |
| 10 | Water Jet Assembly Output Vector |
| 12 | Cutter Head Assembly |
| 14 | Cutter Head Interior Surface |
| 16 | Cutter Head Contour Cutting Teeth |
| 18 | Cutter Head Hub |
| 20 | Cutter Head Ring |
| 22 | Cutter head Conical Back Plate |
| 24 | Suction Pipe |
| 26 | Cutter Head Rotation Shaft |
| 28 | Cutter Head Cavity |
| 30 | Waterway Breach |
| 32 | Waterway Bottom |
| h | Cutter Head Height |
| CL | Centerline |

DETAILED DESCRIPTION

FIG. 1 depicts a simplified conventional dredging operation according to the prior art. Generally, a surface vessel or dredger is positioned over the area targeted for dredging and one of two spud poles are extended from the bow area of the vessel to the water bed. The spud poles are elevatably moveable and spaced laterally across the vessel's bow. The spud poles stabilize the surface vessel during dredging operations. A ladder assembly is then lowered from the aft portion of the vessel to the waterway bottom. The ladder assembly comprises a suction pipe and a cutter head rotation shaft. The cutter head rotation shaft engages a cutter head hub and drives a cutter head assembly. The cutter head assembly is positioned at the waterway bottom and chisels or comminutes any solid material encountered, such as hard rock. Waterway soil and comminuted rock are drawn into the cutter head assembly and then suctioned up the suction pipe to the surface vessel.

Figure 2B:
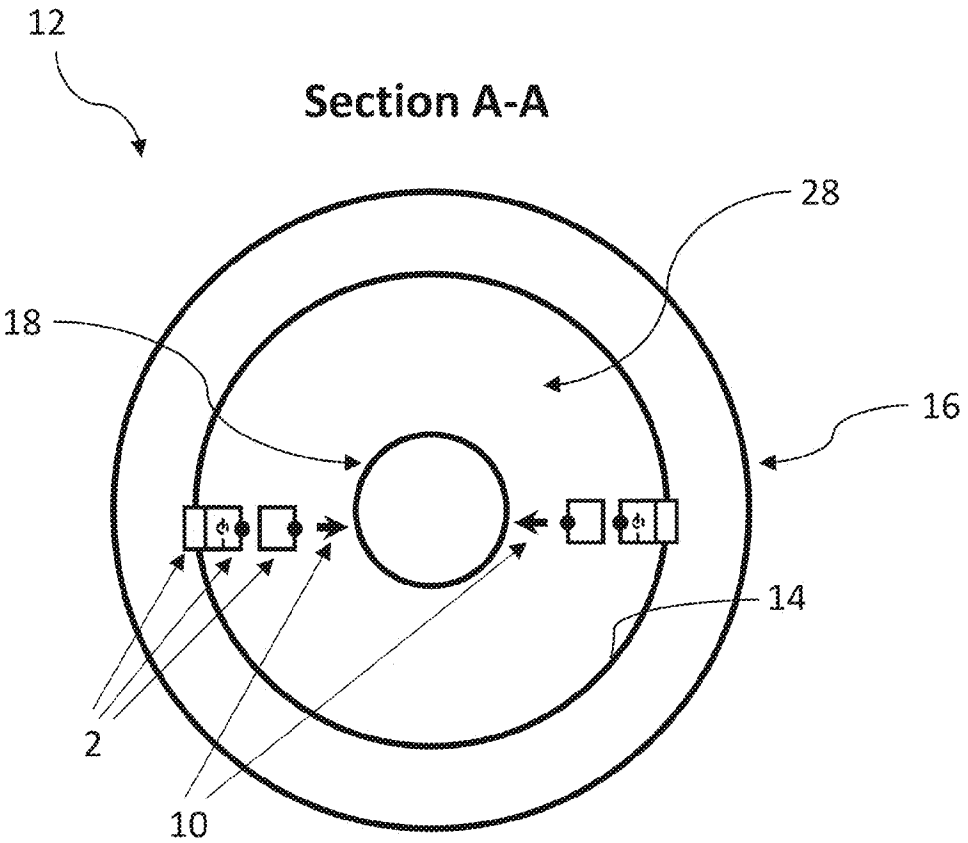
FIG. 2B depicts a cross-sectional view of section A-A of FIG. 2A.
Figure 2C:
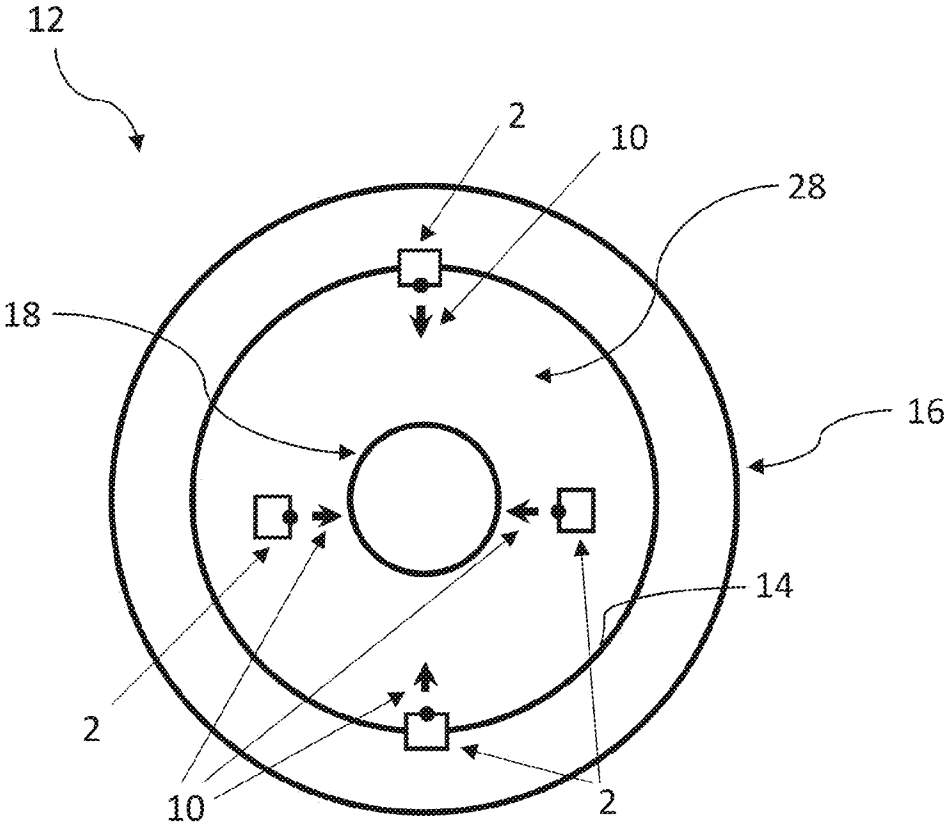
FIG. 2C depicts a cross-sectional view of the cutter head assembly of the dredge mining system of another embodiment of the present invention.

FIGS. 2A-B depict cross-sectional side elevation views of a portion of the dredge mining system of one embodiment of the present invention. More specifically, FIG. 2A depicts a cross-sectional side elevation view of the cutter head assembly portion 12 of the dredge mining system of one embodiment of the system and FIG. 2B depicts a cross-sectional view of section A-A of FIG. 2A. FIG. 2C depicts a cross-sectional view of the cutter head assembly of the dredge mining system of another embodiment of the present invention.

Referring to FIGS. 2A-B, the elements of the Water Jet Assembly 2 as engaged with the Cutter Head Assembly 12 of the Dredge Mining System 1 is provided. Water Jet Assembly 2 comprises Water Jet Assembly Lower Portion 4, Water Jet Assembly Upper Portion 6 and Water Jet Assembly Output Port 8. The Water Jet Assembly 2 receives water and discharges the water through Water Jet Assembly Output Port 8 along Water Jet Assembly Output Vector 10. The Cutter Head Assembly 12 comprises Cutter Head Interior Surface 14 defining Cutter Head Cavity 28, Cutter Head Contour Cutting Teeth 16, Cutter Head Hub 18, Cutter Head Ring 20, Cutter Head Conical Back Plate 22 and Cutter Head Height h. The Cutter Head Rotation Shaft 26 interconnects with, and supports, the Cutter Head Assembly 12 by way of the Cutter Head Hub 18. The Cutter Head Ring 20 is in communication with a conventional ladder of a dredging surface vessel, as discussed above with regards to FIG. 1. The Cutter Head Rotation Shaft 26 rotates the Cutter Head Assembly 12, which comminutes solid material encountered during dredging. During dredging operations, the Cutter Head Assembly 12 engages Waterway Bottom 32, forming a Waterway Breach 30, and comminutes solid material, such as hard rock, disposed at or in Waterway Bottom 32. The comminuted solid material enters the Cutter Head Cavity 28 at lower or distal end of Cutter Head Assembly 12 and is ingested by Suction Pipe 24. The comminuted solid material, along with waterway soil, are suctioned up the Suction Pipe 24 to the surface vessel. The Suction Pipe 24 and Cutter Head Rotation Shaft 26 are conventional and may be any type known to those skilled in the art suitable for use with the Cutter Head Assembly 12. Cutter Head Rotation Shaft 26 has centerline CL.

The Water Jet Assembly 2 is configured to create cavitation bubbles within the Cutter Head Cavity 28, the cavitation bubbles urging comminution of solid material disposed within the Cutter Head Cavity 28. (See FIG. 3 and associated description below regarding the cavitation bubble mechanism of the Water Jet Assembly 2). In one embodiment, the cavitation bubbles urge confinement of solid material within the Cutter Head Assembly 12 and/or Cutter Head Cavity 28, thereby minimizing losses of dredged material and raising the efficiency and effectiveness of dredging operations. In one embodiment, the cavitation bubbles create a cavitating zone thereby increasing material interaction within the vortex.

In one embodiment, the Water Jet Assembly 2 is configured to create a vortex flow within the cavity, the vortex flow urging the receipt of the solid material by the suction pipe and/or urging comminution of solid material disposed within the Cutter Head Cavity 28 through engagement with the vortex flow.

Water Jet Assembly 2 generally comprises a Water Jet Assembly Lower Portion 4, a Water Jet Assembly Upper Portion 6 and a Water Jet Assembly Output Port 8. The Water Jet Assembly 2 receives water and discharges the water through Water Jet Assembly Output Port 8 along Water Jet Assembly Output Vector 10. In FIGS. 2A-B, a configuration of six (6) water jets is shown. The water jets are disposed along the interior of the Cutter Head Assembly 12, that is along the Cutter Head Interior Surface 14, in a symmetrical configuration about centerline CL of Cutter Head Rotation Shaft 26. Each of the six (6) water jets emits water toward the interior center portion of the Cutter Head Cavity 28.

The six (6) Water Jet Assemblies 2 are generally positioned in groups of three (3) at one hundred eighty (180) degree radials from the centerline of the Cutter Head Hub 18, with each of the two (2) sets of three (3) Water Jet Assemblies 2 positioned at a different radial distances from the Cutter Head Hub 18 centerline. In other embodiments, one or more Water Jet Assemblies are positioned at radials every thirty (30) degrees, forty-five (45) degrees, sixty (60) degrees and/or one-hundred twenty (12) degrees from the centerline of the Cutter Head Hub 18.

An alternate embodiment of the Water Jet Assembly 2 as engaged with the Cutter Head Assembly 12 of the Dredge Mining System 1 is provided as FIG. 2C. Specifically, a cross-sectional view of the cutter head assembly portion of the dredge mining system is depicted. The cross-section is taken along the section A-A of FIG. 2A, but depicts an alternate configuration of the water jets. The Cutter Head Assembly 12 comprises Cutter Head Interior Surface 14 defining Cutter Head Cavity 28, Cutter Head Contour Cutting Teeth 16 and Cutter Head Hub 18. Each of four (4) Water Jet Assemblies 2 receives water and discharges water along respective Water Jet Assembly Output Vectors 10. Each of four (4) Water Jet Assemblies 2 are positioned at ninety (90) degree radials from the centerline of the Cutter Head Hub 18, with two (2) of the four (4) Water Jet Assemblies 2 positioned at a radial distance smaller than the remaining two (2) Water Jet Assemblies 2. Additional arrangements or configurations of one or more water jets are possible as long as the arrangement or configuration urges comminution of solid material disposed within the Cutter Head Cavity 28 by way of cavitation and/or vortex flow.

In one embodiment, a plurality of water jets are disposed on the cutter head interior surface so as to be flush with the cutter head interior surface. In another embodiment, a plurality of water jets are disposed on or within the cutter head interior surface along concentric rings (i.e. concentric radial locations) about the centerline of the cutter head hub.

In one embodiment, one or more water jets emit water at a variable pressure, and/or a pressure different than another one or more water jets. In another embodiment, the spray pattern of one or more water jets comprises a planar spray, a spherical spray, a conical spray and a pulsed spray. In another embodiment, the orientation of one or more water jets is static, that is, stationary or fixed. In another embodiment, the orientation of one or more water jets is dynamic, that is variable either by manual adjustment or by computer-control.

In one embodiment, one or more of a plurality of water jet assemblies are disposed on the Cutter Head Interior Surface 14 such that water jet assemblies disposed closer to the Cutter Head Hub 18 are more aligned with the Cutter Head Interior Surface 14 and are substantially or generally oriented to emit water toward the Suction Pipe 24, whereas those water jet assemblies disposed relatively further to the Cutter Head Hub 18 are substantially vertical to the Cutter Head Interior Surface 14 (see Water Jet Assembly Output Vectors 10).

In one embodiment, the Water Jet Assembly 2 can be controlled by any means known to those skilled in the art, to include by an electric motor, a hydraulic motor and pneumatic motor. In one embodiment, a controller is used to controls emission characteristics of the Water Jet Assembly 2, the emission characteristics comprising water pressure, water flow rate, direction, pulse rate and spray pattern. In one embodiment, the controller utilizes control algorithms comprising at least one of on/off control, proportional control, differential control, integral control, state estimation, adaptive control and stochastic signal processing.

In one embodiment, the water provided to the Water Jet Assembly 2 is supplied from high pressure pumps mounted at the surface, on a surface vessel or on the dredge arm of a cutter-suction dredger. In one embodiment, one or more water jets emit a fluid other than water or a fluid comprising water and another material. For example, one or more water jets may emit a liquid comprising water and an abrasive such as sand.

In one embodiment, the Cutter Head Interior Surface 14 may comprise inner contour cutting blades. In one embodiment, one or more Water Jet Assemblies 2 are configured to create streams of cavitation bubbles emanating from or near the trailing edge of inner contour cutting blades of the Cutter Head Assembly 12.

In yet another embodiment, the Water Jet Assembly 2 is adaptable to dredge cutting heads of different design, to include those known to those skilled in the art. In one embodiment, the Water Jet Assembly 2 is adaptable and/or configured to use external piping and cavitation nozzles to the cutting blades of the Cutter Head Interior Surface 14 and/or by incorporating the piping and nozzles into the cutting blades.

In one embodiment, the Water Jet Assembly 2, through one or both functions of creating a vortex flow within the Cutter Head Cavity 28 and creating cavitation bubbles within the Cutter Head Cavity 28, reduces the amount of spillage while dredging and thereby, increases production and recovery rates while reducing sediment suspension and pollution. Furthermore, the Water Jet Assembly 2, through one or both functions of creating a vortex flow within the Cutter Head Cavity 28 and creating cavitation bubbles within the Cutter Head Cavity 28, creates an environment where comminution of larger particles takes place away from the suction intake, which reduces the chance for partial blockages and the need for additional comminution at the surface.

Also, when comminution of larger particles takes place away from the suction intake increased pump efficiencies may be achieved because the pump may be sized to handle smaller material and reduce the amount of spillage of larger and heavier particles. Additional benefits include enabling the rotation speed/torque of the cutter head to be adjusted to increase excavation productivity, and enabling dredging of deposits and other materials that were previously not technically or economically viable.

Figure 3:
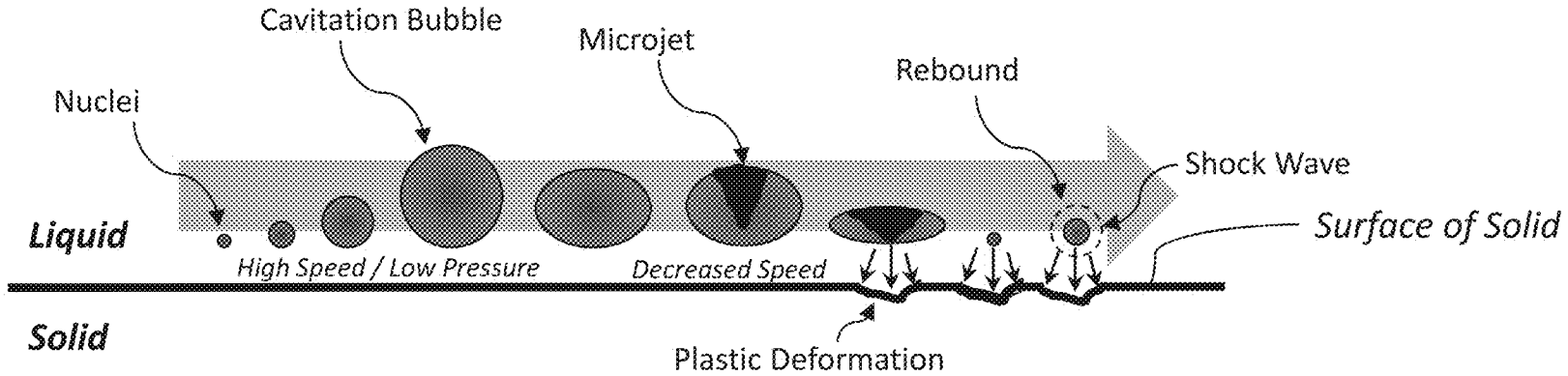
FIG. 3 depicts a pictorial representation of the cavitation bubble mechanism of the water jet assembly of the dredge mining system according to one embodiment of the present invention.

Referring to FIG. 3, a pictorial representation of the cavitation bubble mechanism of the water jet assembly of the dredge mining system 1 is presented. The cavitation bubble mechanism functions to, among other things, urge comminution of solid material disposed within the Cutter Head Cavity 28. Generally, high-pressure water is supplied to the Water Jet Assembly 2 and emitted from the Water Jet Assembly Output Port 8 into the Cutter Head Cavity 28. As the water departs the Water Jet Assembly Output Port 8, which may comprise a nozzle, cavitation bubbles are created. The cavitation bubbles implode and create one or more shock waves; the shock waves, in impacting the solid material, serve to break-apart the solid material disposed within the Cutter Head Cavity 28.

In yet another embodiment, the disclosed systems and methods may be partially implemented in software that can be stored on a storage medium to include a computer-readable medium, executed on programmed general-purpose computer with the cooperation of a controller and memory, a special purpose computer, a microprocessor, or the like. In these instances, the systems and methods of this disclosure can be implemented as program embedded on personal computer such as an applet, JAVA® or CGI script, as a resource residing on a server or computer workstation, as a routine embedded in a dedicated measurement system, system component, or the like. The system can also be implemented by physically incorporating the system and/or method into a software and/or hardware system.

In one embodiment, one or more computers are used to control, among other things, the water pressure, water flow rate, direction, pulse rate and spray pattern of one or more water jet assemblies. In one embodiment, a user selectively inputs one or more of the water pressure, water flow rate, direction, pulse rate and spray pattern of one or more water jet assemblies.

In one embodiment, the user interacts with the computer through any means known to those skilled in the art, to include a keyboard and/or display to include a touch-screen display. The term "computer-readable medium" as used herein refers to any tangible storage and/or transmission medium that participate in providing instructions to a processor for execution. Such a medium may take many forms, including but not limited to, non-volatile media, volatile media, and transmission media. Non-volatile media includes, for example, NVRAM, or magnetic or optical disks. Volatile media includes dynamic memory, such as main memory. Common forms of computer-readable media include, for example, a floppy disk, a flexible disk, hard disk, magnetic tape, or any other magnetic medium, magneto-optical medium, a CD-ROM, any other optical medium, punch cards, paper tape, any other physical medium with patterns of holes, a RAM, a PROM, and EPROM, a FLASH-EPROM, a solid state medium like a memory card, any other memory chip or cartridge, a carrier wave as described hereinafter, or any other medium from which a computer can read. A digital file attachment to e-mail or other self-contained information archive or set of archives is considered a distribution medium equivalent to a tangible storage medium. When the computer-readable media is configured as a database, it is to be understood that the database may be any type of database, such as relational, hierarchical, object-oriented, and/or the like. Accordingly, the disclosure is considered to include a tangible storage medium or distribution medium and prior art-recognized equivalents and successor media, in which the software implementations of the present disclosure are stored.

Although much of this disclosure references dredging operations, the device and methods thereof may be used in other applications in which communition is desirable, such as mining in water-rich environments. Also, with regard to existing earth moving and mining methods, embodiments of the invention provide the following operational, safety and environmental benefits.

Operational benefits include less equipment required per ton of dredged material removed, therefore lower operating and capital costs, and reduced start-up time. Also, fewer personnel are required to operate and maintain the dredging system and its cutter head assembly, in part because the mining or earth-moving cycle is continuous with minimal resistance and the use of explosives is reduced if not eliminated. Because comminution occurs at the point of excavation, several transport-related benefits ensue because the dredged material may be transported by pipeline from a pit to a mill, stockpills, placement areas or to a waste dump. Such pipeline transport is more efficient than conventional truck transport and requires less supportive infrastructure, such as road construction and road maintenance. Mining may also take place in isolated areas using diesel-powered dredges and pumps to transport to stockpile areas. Additionally, any ore existing in the dredged material may be sorted while in the pipeline and processing may occur in the pipeline, e.g. reagents added or mixing performed.

Safety benefits include those derived from the reduced manpower levels and reduced operational safety risks. For example, the more efficient and effective cutter head assembly minimizes the use of explosives, thereby lowering the risk to staff involving the use of explosives. Also, increased pit slope stability results in a more stable and therefore safer working platform (i.e. the surface vessel is more stable).

Lastly, the disclosed apparatus and method for a cutting head that more efficiently and effectively dredges in the presence of hard rock than conventional techniques provides several environmental benefits. For example, given comminution occurs at the point of excavation, no dewatering is required and therefore the discharge of pit water may be eliminated and mining may be conducted in existing flooded pits unable to satisfy environmental requirements of dewatering permits. Furthermore, the apparatus and method may be used in a greenfield mine where a water table is relatively high, and reduced losses during dredging provide improved water quality. Also, environmental visualization is improved with respect to a conventional "hole in the ground" visualization. Finally, because of the reduced equipment required per ton of material removed, pollution and carbon footprint are reduced, minimal to no dust is produced, and diesel exhaust is minimized.

As will be appreciated, it would be possible to provide for some features of the inventions without providing others.

One of ordinary skill in the art will appreciate that embodiments of the present disclosure as provided in FIGS. 1-4 may be used in applications other than dredging. For example, in applications in which excavation is required in the presence of hard rock and liquids.

What is claimed is:

1. A cutter head and water jet assembly system for removing rock and debris, comprising:

an assembly body having an upper portion engaged with each of a suction pipe and a rotation shaft, and a lower portion comprising a cutter head, the upper portion and the lower portion defining a cavity, wherein the rotation shaft is configured to rotate the cutter head, and the suction pipe is configured to suction particles comprising solid materials into the cavity; and one or more water jets disposed on a surface of the cavity and configured to emit a spray of water into the cavity;

wherein the one or more water jets create cavitation bubbles within the cavity, the cavitation bubbles urging comminution of the solid materials disposed within the cavity.

2. The system of claim 1, further comprising a controller which controls emission characteristics of the one or more water jets comprising water pressure, a water flow rate, a direction of flow, a pulse rate and a spray pattern.

3. The system of claim 1, wherein the one or more water jets direct water to a centerline of the cavity.

4. The system of claim 1, wherein the one or more water jets further create a vortex flow within the cavity, the vortex flow urging the receipt of the solid material by the suction pipe.

5. The system of claim 1, wherein the one or more water jets emit a spray pattern comprising a planar spray, a spherical spray, a conical spray and a pulsed spray.

6. The system of claim 1, wherein the one or more water jets are disposed substantially flush on the surface of the cavity.

7. The system of claim 3, wherein the one or more water jets are disposed at concentric radial locations about a centerline of the rotation shaft.

8. The system of claim 1, wherein the one or more water jets operate at adjustable water pressures.

9. The system of claim 1, wherein the one or more water jets emit water at adjustable orientations with respect to a centerline of the rotation shaft.

10. A method for dredging a waterway, comprising:

providing a cutter head and water jet assembly, the assembly comprising an assembly body having an upper portion engaged with each of a suction pipe and a rotation shaft, and a lower portion comprising a cutter head, the upper portion and the lower portion defining a cavity; and one or more water jets disposed on a surface of the cavity and configured to emit a spray of water into the cavity;

positioning the cutter head on the bottom of the waterway;

rotating the cutter head through rotation of the rotation shaft;

suctioning particles comprising solid materials into the cavity;

emitting a spray of water into the cavity from the one or more water jets;

creating cavitation bubbles within the cavity, the cavitation bubbles urging comminution of the solid materials disposed within the cavity; and suctioning the particles from the cavity into the suction pipe to a surface vessel, wherein the waterway is dredged.

11. The method of claim 1, further comprising a controller which controls emission characteristics of the one or more water jets comprising water pressure, water flow rate, direction, pulse rate and spray pattern.

12. The method of claim 10, wherein the one or more water jets further create a vortex flow within the cavity, the vortex flow urging the receipt of the solid material by the suction pipe.

13. The method of claim 10, wherein the one or more water jets emit a spray pattern comprising a planar spray, a spherical spray, a conical spray and a pulsed spray.

14. The method of claim 10, wherein the one or more water jets are a plurality of water jets disposed at concentric radial locations about a centerline of the rotation shaft.

15. The method of claim 10, wherein the one or more water jets operate at adjustable water pressures.

16. The system of claim 10, wherein the one or more water jets emit water at adjustable orientations with respect to a centerline of the rotation shaft.

17. A cutter head and water jet device adapted to remove solid materials in a dredging operation, comprising:

a device body having an upper portion engaged with each of a suction pipe and a rotation shaft, and a lower portion comprising a cutter head, the upper portion and the lower portion defining a cavity, wherein the rotation shaft is configured to rotate the cutter head, and wherein the suction pipe is configured to suction particles comprising solid materials into the cavity; and a plurality of water jets disposed on a surface of the cavity and configured to emit a spray pattern of water into the cavity, the spray pattern comprising a planar spray, a spherical spray, a conical spray and a pulsed spray;

wherein the plurality of water jets create cavitation bubbles within the cavity, the cavitation bubbles urging comminution of the solid materials disposed within the cavity, wherein the plurality of water jets operate at adjustable water pressures; and wherein the plurality of water jets emit water at adjustable orientations with respect to a centerline of the rotation shaft.

18. The device of claim 17, further comprising a controller which controls emission characteristics of the plurality of water jets comprising at least one of a water pressure, a water flow rate, a direction of flow, a pulse rate and a spray pattern.

19. The device of claim 17, wherein the plurality of water jets further create a vortex flow within the cavity, the vortex flow urging the receipt of the solid material by the suction pipe.

20. The system of claim 17, wherein the plurality of water jets are disposed at concentric radial locations about a centerline of the rotation shaft.

* * * * *